United States Patent [19]

Stefannson et al.

[11] 4,444,388

[45] Apr. 24, 1984

[54] STACKING METHODS AND APPARATUS

[75] Inventors: Rafn Stefannson, San Marino; Raymond M. McManaman, Glendora, both of Calif.

[73] Assignee: Bell & Howell Company, Chicago, Ill.

[21] Appl. No.: 303,298

[22] Filed: Sep. 15, 1981

[51] Int. Cl.[3] ..... B65H 29/58

[52] U.S. Cl. ..... 271/293; 271/184; 271/219; 271/220; 271/225; 271/DIG. 9; 271/305

[58] Field of Search ..... 271/293, 178, 184, 186, 271/219, DIG. 9, 220, 225, 279, 305

[56] References Cited

U.S. PATENT DOCUMENTS

| | | | |
|---|---|---|---|
| 2,020,925 | 11/1935 | Young . | |
| 2,132,231 | 10/1938 | Dunser . | |
| 2,626,800 | 1/1953 | Martin . | |
| 2,771,293 | 11/1956 | Guttridge . | |
| 2,822,171 | 2/1958 | Luning . | |
| 2,933,313 | 4/1960 | Stobb . | |
| 2,970,836 | 2/1961 | Smith . | |
| 3,079,151 | 2/1963 | Maidment . | |
| 3,148,879 | 9/1964 | Kistner . | |
| 3,994,487 | 11/1976 | Wicklund . | |
| 4,067,568 | 1/1978 | Irvine . | |
| 4,176,945 | 12/1979 | Holzhauser | 271/186 X |
| 4,241,909 | 12/1980 | Murphy | 271/182 |
| 4,365,794 | 12/1982 | Roller | 271/186 |

*Primary Examiner*—Richard A. Schacher

*Attorney, Agent, or Firm*—Benoit Law Corporation

[57] ABSTRACT

Methods and apparatus for stacking sheets of various intermixed lengths in a stacking location employ distinct first and second sheet drive rollers at a sheet feed path adjacent said stacking location. The first sheet drive rollers are rotated in a first sense of rotation for driving each sheet along the sheet feed path in a first direction. The second sheet drive rollers are for each of the sheets maintained out of the sheet feed path while the particular sheet is driven with the first sheet drive roller means in the first direction past a stacking position at the stacking location. The second sheet drive rollers are rotated in a second sense of rotation for driving each sheet in a second direction opposed to said first direction. The second sheet drive rollers are for each sheet driven past the stacking location introduced into the sheet feed path for driving the particular sheet in said second direction into the stacking location.

30 Claims, 5 Drawing Figures

STACKING METHODS AND APPARATUS

BACKGROUND OF THE INVENTION

1. Field of the Invention

The subject invention relates to stacking methods and apparatus and, more specifically, to methods and apparatus for stacking papers, documents, cards and other sheets of various intermixed lengths, thicknesses and other characteristics.

2. Disclosure Statement

The following disclosure statement is made pursuant to the duty of disclosure imposed by law and formulated in 37 CFR 1.56(a). No representation is hereby made that information thus disclosed in fact constitutes prior art, inasmuch as 37 CFR 1.56(a) relies on a materiality concept which depends on uncertain and inevitably subjective elements of substantial likelihood and reasonableness and inasmuch as a growing attitude appears to require citation of material which might lead to a discovery of pertinent material though not necessarily being of itself pertinent. Also, the following comments contain conclusions and observations which have only been drawn or become apparent after conception of the subject invention or which contrast the subject invention or its merits against the background of developments which may be subsequent in time or priority.

There is an increasing demand for methods and apparatus for stacking various documents, papers and other sheets rapidly and reliably, without paper jams and other disturbances.

To a large extent, this demand has been sparked by the desire of public utilities, banks and other institutions to economize, automate and speed up the processing of payments by customers. In practice, the resulting advanced remittance processing systems require high-speed stackers capable of handling such items as bank checks and remittance stubs of various intermixed lengths, thicknesses, formats, textures and surface finishes. Such stackers are to be capable of stacking received documents or sheets in their original sequential order in which they were fed into the stacking apparatus or system.

For a relatively early card sorting machine, reference may be had to U.S. Pat. No. 2,020,925, by D. A. Young, issued Nov. 12, 1935. In such early machines, cards were fed into the stack from the bottom thereof with the aid of card holders, dogs and cams.

Reference may also be had to U.S. Pat. No. 3,132,231, by J. F. Dunser, issued Oct. 4, 1938 and disclosing apparatus for sorting flexible sheet material, U.S. Pat. No. 2,626,800, by G. A. Martin, issued Jan. 27, 1953 and disclosing sheet delivering apparatus, U.S. Pat. No. 2,771,293, by E. J. Guttridge, issued Nov. 20, 1956, and disclosing record card controlled statistical machines, U.S. Pat. No. 2,822,717, by G. A. Luning, issued Feb. 4, 1958 and disclosing a stacker arrangement in which roller combinations cause cards to snap into a stacking position, U.S. Pat. No. 2,933,313, by A. R. Stobb, issued Apr. 19, 1960, and disclosing methods and apparatus for collecting flexible sheets, U.S. Pat. No. 2,970,836, by J. G. Smith, issued Feb. 7, 1961 and disclosing stackers in which sheets are blown into the stacking location, U.S. Pat. No. 3,079,151, by E. P. Maidment, issued Feb. 26, 1963 and disclosing a document handling stacking apparatus, U.S. Pat. No. 3,994,487, by H. P. Wicklund, issued Nov. 30, 1976 and disclosing a sheet handling apparatus for stacking burst sheets with the aid of roller mechanisms, and U.S. Pat. No. 4,067,568, by R. Irvine, issued Jan. 10, 1978 and disclosing stacking apparatus in which items, such as envelopes, are fed into a stacking location from below with the aid of a planetary roller assembly. Most of these existing proposals depend on certain given sheet or item dimensions for their proper operation. The proposal according to U.S. Pat. No. 3,148,879, by H. J. Kistner, issued Sept. 15, 1964, attempts to strike a certain compromise by providing a stacking apparatus with a length adjustment facility. In this manner, it appears possible for the stacking apparatus to handle one length of sheets at one time, and another length of sheets at another time. However, this still does not permit a stacking of sheets at variously intermixed lengths. Also, that proposal employed a leaf spring for driving advancing sheets into the stack, thereby introducing an inherent speed dependency. Moreover, that proposal required oscillating pushers for placing the sheets into the stack.

A more recent type of document stacking apparatus, illustrated in U.S. Pat. No. 4,241,909, by Murphy et al, issued Dec. 30, 1980 employs a gravity-bias principle in conjunction with a power drive roller having an elastomeric serrated extended diameter cap, and a roller mechanism, rotatable in a direction counter to that which would normally feed documents along a predetermined path, for retarding the movement of the documents and facilitating their stacked arrangement within the stacking cavity. In this respect, the embodiment illustrated in the latter patent shows a support roller having a pair of smaller rollers mounted thereon for retarding advancing documents to a proper extent for stacking within the apparatus. In a commercial version of that type of stacker, a reversely rotating square-shaped elastomeric member is employed in lieu of the latter illustrated document retarding roller mechanism.

In practice, gravity-bias systems are not universally applicable. Also, the use of elastomeric serrated roller caps or square-shaped roller members may impose noticeable vibration on the stacking apparatus and entail accelerated wear.

SUMMARY OF THE INVENTION

It is a general object of the subject invention to overcome the problems and to meet the needs expressed or implicit in the above disclosure statement or in other parts hereof.

It is a germane object of this invention to provide improved document stacking methods and apparatus.

It is a related object of this invention to provide improved methods and apparatus for stacking sheets of various intermixed lengths.

Other objects of the invention will become apparent in the further course of this disclosure.

From a first aspect thereof, the subject invention resides in a method of stacking sheets of various intermixed lengths in a stacking location with the aid of distinct first and second sheet drive roller means at a sheet feed path adjacent the stacking location. According to this aspect, the invention resides in the improvement comprising, in combination, the steps of rotating the first sheet drive roller means in a first sense of rotation for driving each of the sheets along the sheet feed path in a first direction, maintaining for each of said sheets the second sheet drive roller means out of the sheet feed path while driving the particular sheet with the first sheet drive roller means in the first direction past a stacking position at the stacking location, rotating the second sheet drive roller means in a second sense of rotation for driving each of the sheets in a second direction opposed to the first direction, and introducing for each of the sheets driven past the stacking position the second sheet drive roller means into the sheet feed path for driving the particular sheet in the second direction into the stacking location, the first sheet drive roller means being maintained radially stationary at the sheet feed path before, during and after each introduction of the second sheet drive roller means into the sheet feed path, and each of the sheets being applied to the radially stationary first sheet drive roller means for driving along the sheet feed path in the first direction.

From another aspect thereof, the invention resides in the improvement comprising, in combination, the steps of providing at the sheet feed path a sheet stack retaining wall being shorter in a first direction than the shortest sheet length, rotating the first sheet drive roller means in a first sense of rotation for driving each of the sheets along the sheet feed path in the first direction, maintaining for each of the sheets the second sheet drive roller means out of the sheet feed path while driving the particular sheet with the first sheet drive roller means in the first direction past an outside of the sheet stack retaining wall, rotating the second sheet drive roller means in a second sense of rotation for driving each of the sheets in a second direction opposed to the first direction, introducing for each of the sheets driven past the retaining wall the second sheet drive roller means into the sheet feed path for driving the particular sheet in the second direction into the stacking location at an inside of the retaining wall opposite the outside, and pressing the sheet in the stacking location against the inside of the retaining wall.

From another aspect thereof, the subject invention resides in apparatus for stacking sheets of various intermixed lengths in a stacking location and, more specifically, resides in the improvement comprising, in combination, means for driving the sheets to the stacking location, including first sheet drive roller means rotating in a first sense of rotation for driving each of the sheets along a sheet feed path in a first direction past a stacking position at the stacking location, second sheet drive roller means rotating in a second sense of rotation for driving each of the sheets in a second direction opposed to the first direction, and means coupled to the first and second roller means for first maintaining for each of the sheets the second sheet drive roller means out of the sheet feed path while applying to the particular sheet first the first sheet drive roller means and for then introducing the second sheet drive roller means into the sheet feed path for driving the particular sheet in the second direction into the stacking location, and means for maintaining the first sheet drive roller means radially stationary at the sheet feed path before, during and after each introduction of the second sheet drive roller means into the sheet feed path, the driving means including means for applying each of the sheets to the radially stationary first sheet drive roller means for the driving of each of the sheets along the sheet feed path in the first direction.

From another aspect thereof, the invention resides in the improvement comprising, in combination, a sheet stack retaining wall at the stacking location, being shorter in a first direction than the shortest sheet length, means for driving the sheets to the stacking location, including first sheet drive roller means rotating in a first sense of rotation for driving each of the sheets along a sheet feed path in the first direction past an outside of the sheet stack retaining wall, second sheet drive roller means rotating in a second sense of rotation for driving each of the sheets in a second direction opposed to the first direction, means coupled to the first and second drive roller means for first maintaining for each of the sheets the second sheet drive roller means out of the sheet feed path while applying to the particular sheet first the first sheet drive roller means and for then introducing the second sheet drive roller means into the sheet feed path for driving the particular sheet in the second direction into the stacking location at an inside of the retaining wall opposite its outside, and means for pressing the latter sheet in the stacking location against the inside of the retaining wall.

Other aspects of the subject invention are set forth or will become apparent in the further course hereof, and no limitation to any steps, components or combinations is intended by the subject summary of the invention.

BRIEF DESCRIPTION OF THE DRAWINGS

The invention and its various objects and aspects will become more readily apparent from the following detailed description of preferred embodiments thereof, illustrated by way of example in the accompanying drawings, in which like reference numerals designate like or functionally equivalent parts, and in which.

DESCRIPTION OF PREFERRED EMBODIMENTS

Figure 1:
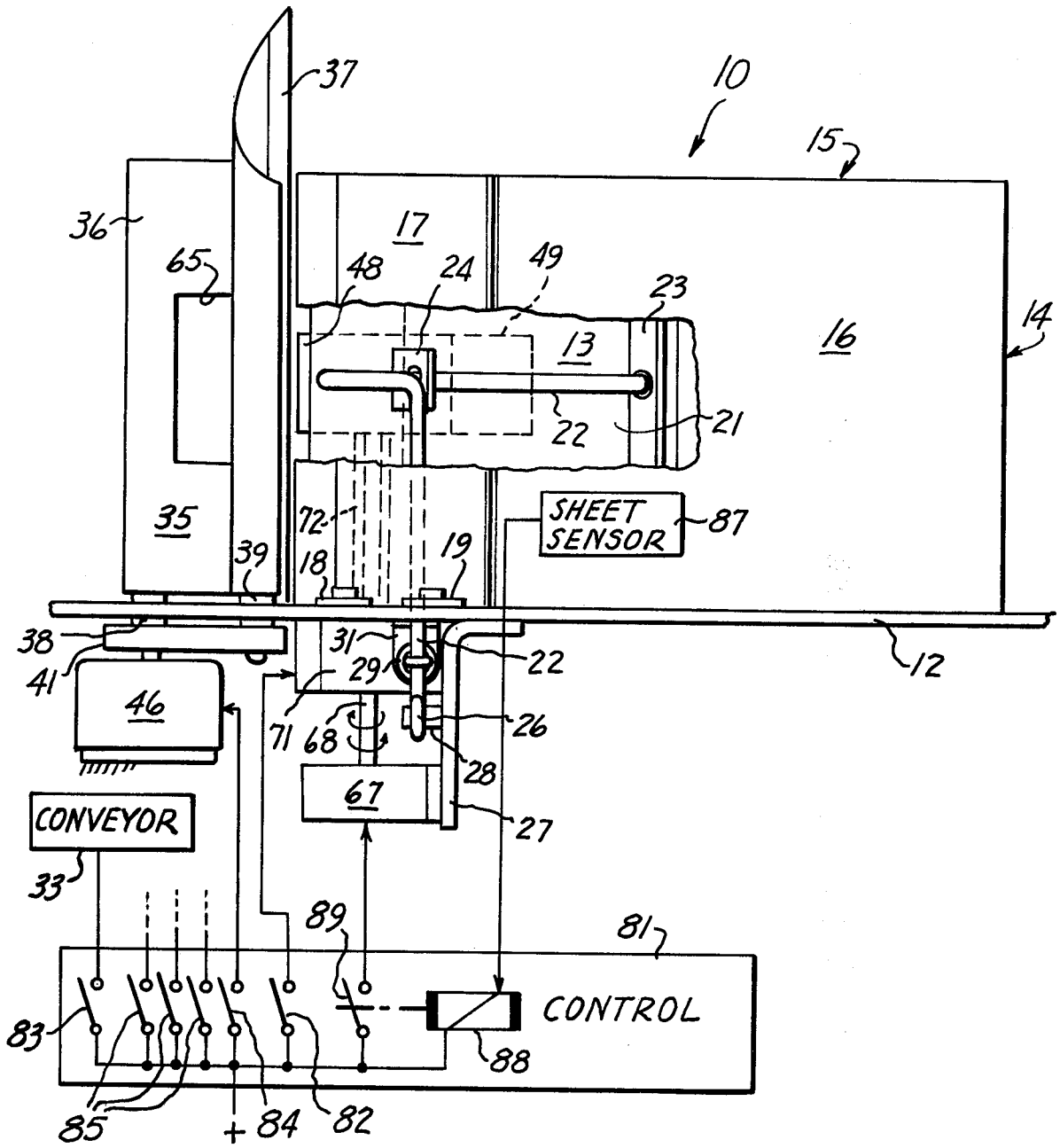
FIG. 1 is a side view of a stacking apparatus, with a diagrammatic showing of certain controls, according to a preferred embodiment of the subject invention.

The stacking apparatus 10 shown in FIGS. 1 to 5 has a baseplate 12 supporting at a stacking location 13 an L or J- shaped partial enclosure 14, constituting with part of the baseplate 12 a stacking bin 15. The partial enclosure 14 includes upright integral walls 16 and 17, which may be attached to the baseplate 12 at 18 and 19, for instance.

The stacking apparatus has a backup plate 21 at the stacking location 13 for releasably retaining stacked sheets in that stacking location. The backup plate 21 is pivotally mounted on an arm 22 which extends through apertures in lugs 23 and 24 projecting rearwardly from the backup plate. The arm 22 extends downwardly through an elongate slot 25 in the baseplate 12 and is pivotally mounted at 26 below the baseplate. A bracket 27 depending from the baseplate and a mounting pin 28 may be employed for pivotally mounting the arm 22. A spring 29 completes means for biasing the backup plate toward a rest position. To this end, the spring 29 may extend between a portion of the arm 22 spaced from the pivot pin 28 and a further bracket 31 depending from the baseplate 12.

Sheets may be forwarded or conveyed to the stacker 10 in any desired manner, and the stacker may form part of any apparatus or system in which stacking of sheets is desired. By way of example and not by way of limitation, sheets may include bank checks and other instruments, payment stubs and other remittance documents, as well as various kinds of papers in general.

Also by way of example, stackers of the type herein described and illustrated have been successfully tested in advanced remittance processing systems. For that purpose, several of the illustrated stackers have been employed in each remittance processing apparatus, where they have successfully stacked bank checks and payment stubs of various lengths, thicknesses, formats, textures and other different properties.

The sheet conveyor is symbolically shown at 33 and has been illustrated as having diagrammatically shown sheet drive equipment 34.

The or each stacker 10 is equipped with a sheet gate 35 for directing a conveyed sheet either into the particular stacker or then past such stacker, as desired. To this end, the gate 35 has two deflector elements 36 and 37 mounted on two posts 38 and 39. These posts, in turn, are mounted on a bracket 41 which is pivotally mounted for angular movement about a longitudinal axis through the post 38. The post 39 extends through an elongate slot 42 in the baseplate 12 so as to afford the gate 35 the necessary freedom of movement between the first position, shown in FIG. 2, in which a conveyed sheet 44 is guided past the illustrated stacker, and a second position illustrated, for instance, in FIG. 3, in which a sheet 45 is guided into the stacker apparatus. The sheet 44 which is guided past the illustrated stacker 10 may subsequently be guided into another stacker of a given apparatus or into any desired location.

Figure 2:
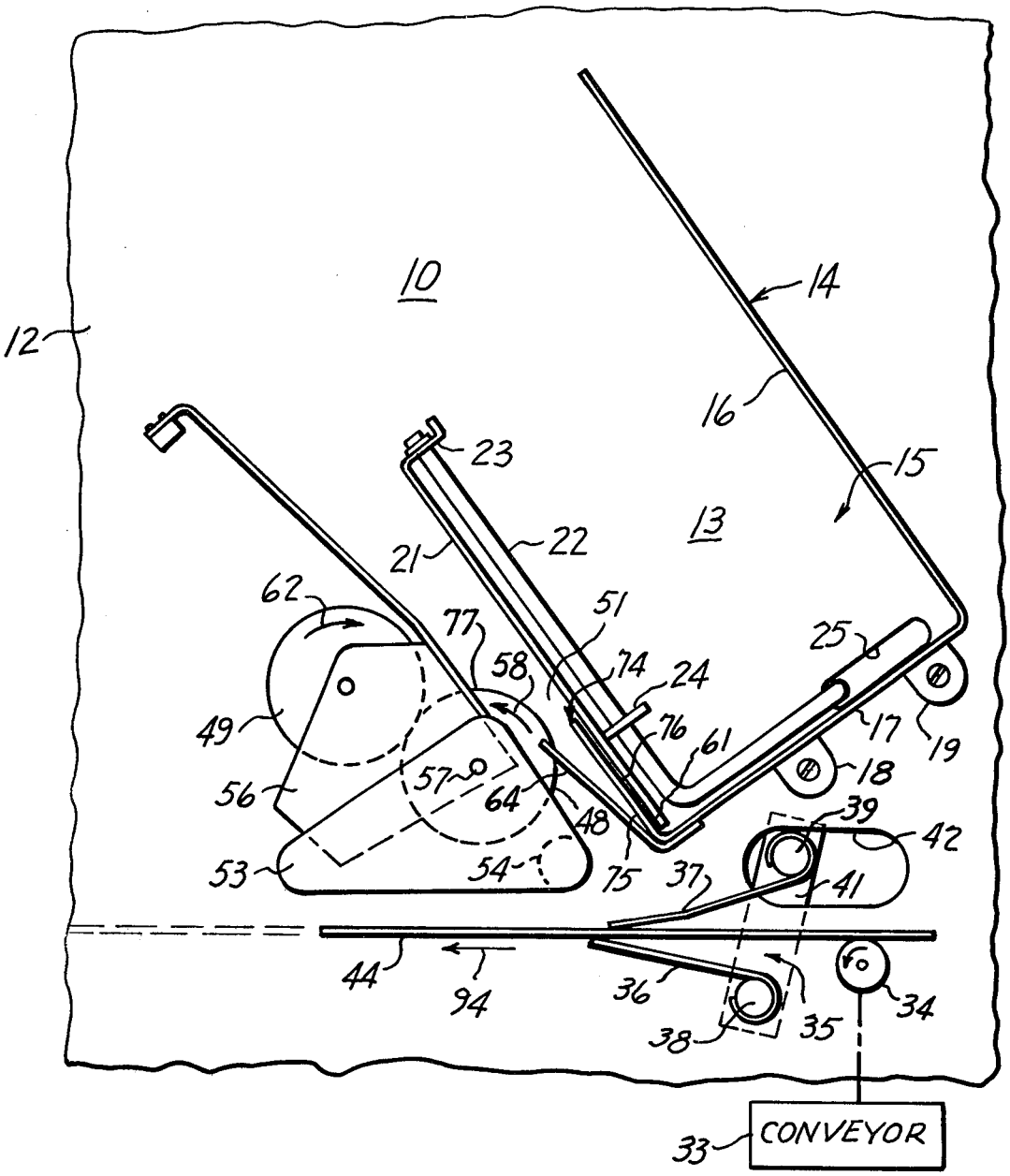
FIGS. 2 to 5 are plan views of the apparatus of FIG. 1 in various operating positions, thereby also illustrating preferred methods according to the subject invention.
Figure 3:
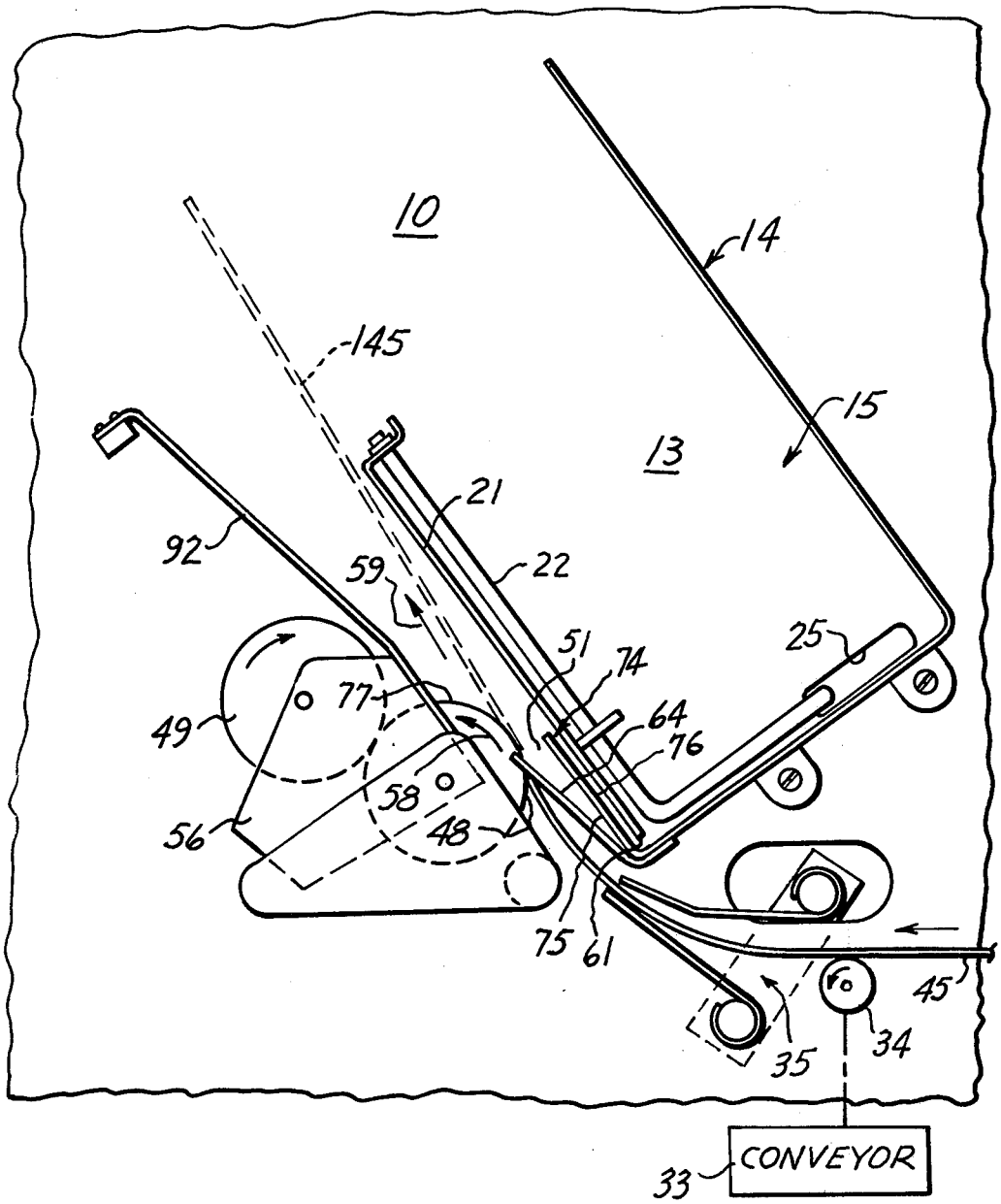

The gate 35 may be actuated between the first position illustrated in FIG. 2 and its second position illustrated in FIGS. 1 and 3, for instance, by a motor or other angular actuator 46 illustrated in FIG. 1.

The conveyor 33 and gate 35 convey the sheet 45 to first sheet drive roller means 48. Only one sheet drive roller has been shown in the drawings at 48, but it should be understood that what is hereinafter referred to as "first sheet drive roller 48" may in fact comprise two or more sheet drive rollers which, for instance, may be mounted on or rotatable about the same axis. Similarly, the drawings show second sheet drive roller means 49 in the form of one roller. Again, what is hereinafter referred to as "second sheet drive roller 49" may in fact comprise two or more rollers which, for instance, may be located on or rotatable about the same axis. However, it should be understood that there are distinct first and second sheet drive rollers or roller means 48 and 49 at a sheet feed path 51 adjacent the stacking location 13.

The first sheet drive roller 48 is located between the baseplate 12 and a top mounting bracket 53, which may extend parallel to the baseplate 12 and be supported by one or more posts or bracket walls, symbolically illustrated by a dotted outline at 54 in FIG. 2.

In the illustrated preferred embodiment, yoke means or a yoke 56 is provided for mounting the first and second drive rollers 48 and 49. The yoke 56 is mounted between the baseplate 12 and top bracket 53 for angular or pivotal movement about an axis 57.

The first sheet drive roller 48 is rotated in a first sense of rotation 58 for driving each of the sheets along the sheet feed path 51 in a first direction 59. In this respect, the expression "each of the sheets" and expressions or like import employed herein are not necessarily meant to refer to each sheet 44, etc. that is transported by the conveyor 33, but, depending on context, may refer to only those sheets 45, etc. which are intended to be fed to a particular stacker 10. For each of such sheets the second sheet drive roller 49 is maintained out of the sheet feed path 21 while the particular sheet 45 is driven with the first sheet drive roller 48 in the first direction past a stacking position 61 at the stacking location.

Figure 4:
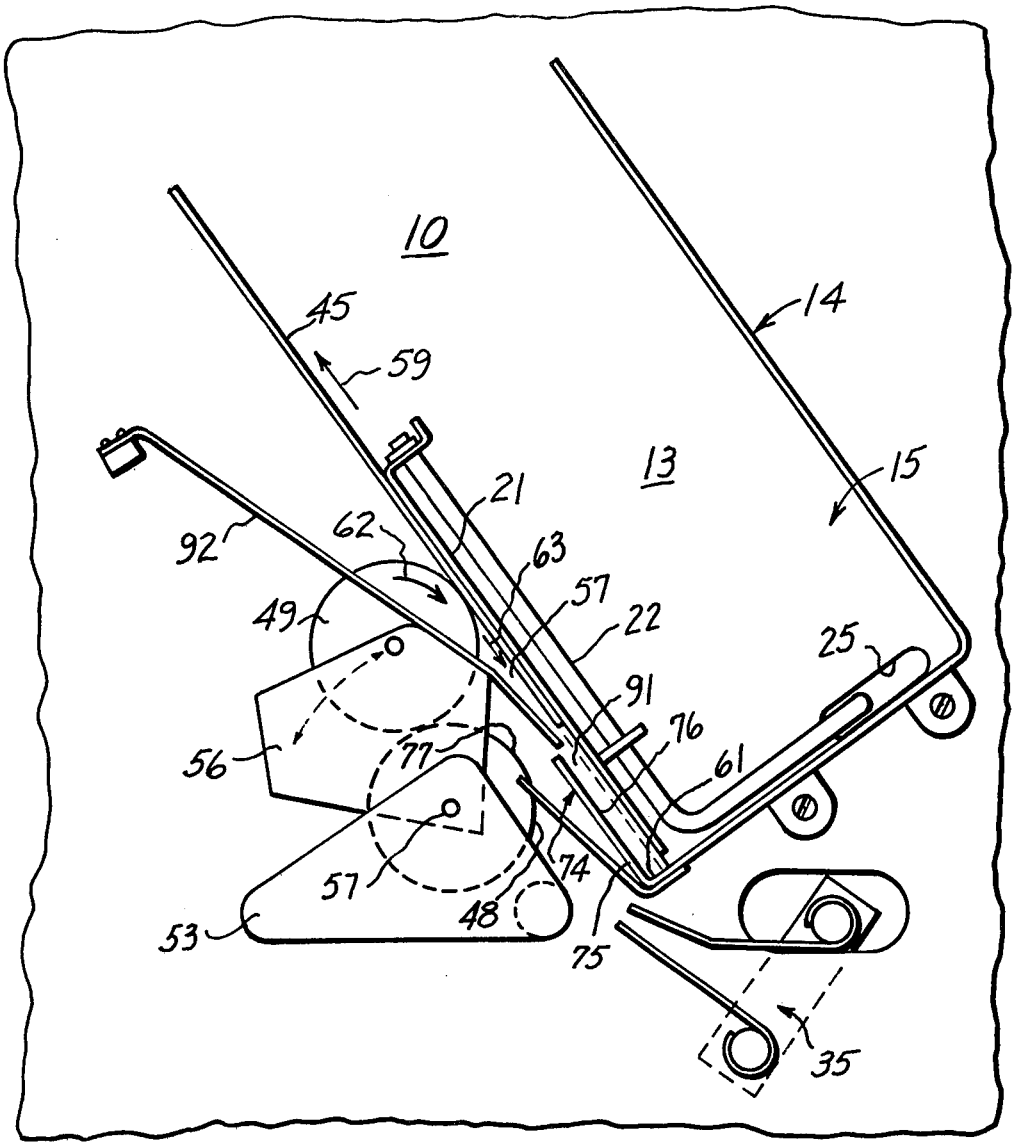

As seen in FIG. 4, the sheet 45 thus overshoots the intended stacking position 61. The second sheet drive roller 49 is rotated in a second sense of rotation 62 for driving each of the sheets 45, etc., in a second direction 63 opposed to the first direction 59.

In this respect, FIG. 4 illustrates the step of introducing, for each of the sheets 45, etc. driven past the stacking position 61, the second sheet drive roller 49 into the sheet feed path 51, for driving the particular sheet 45 in the second direction 63 into the stacking location 13 or stacking position 61.

Reverting for the moment to the first sheet drive roller 48, it may be noted, such as from FIG. 3, that such first sheet drive roller is maintained radially stationary at the sheet feed path 51 during the conveying of each sheet to the first sheet drive roller and during the driving of each sheet in at least the first direction 59.

In other words, although the first sheet drive roller is rotated as described, it is not actuated laterally or radially as in certain prior apparatus for the purpose of engaging and driving an incoming sheet. Rather, the incoming sheets 45 are applied to or are resiliently biased, one at a time, into driving engagement with the first sheet drive roller 48. As indicated in the drawings, a leaf spring member 64 may be employed for this purpose. In particular, the spring member 64 may, for instance, have an end attached to the stacking enclosure 14 or enclosure wall 17, while another end thereof forms a nip at the first roller 48 or otherwise applies incoming sheets 45 to that roller for driving engagement therewith. If avoidance of contact between the spring member 64 and the drive roller 48 would be desired, a cutout could be provided in the front end of the spring member 64, in similarity to the cutout 65 shown for the deflector 36 in FIG. 1.

According to the illustrated preferred embodiment of the subject invention, mounting bracket 53 and yoke 56 or other means are coupled to the first and second sheet drive rollers 48 and 49 for first maintaining for each of the sheets 45, etc. the second sheet drive roller means 49 out of the sheet feed path 51 while applying to the particular sheet first the first sheet drive roller 48, and for then introducing the second sheet drive rollers 49 into the sheet feed path 51 for driving the particular sheet in the second direction 63 into the stacking location 61.

As illustrated in this respect in the drawings, the top bracket 53 in conjunction with the baseplate 12 mounts the yoke 56 for movement from a first position, illustrated in FIGS. 2 and 3, in which the second sheet drive roller 49 is maintained out of the sheet feed path 51 while a sheet 45 is applied to the first sheet drive roller 48, to a second position, illustrated in FIG. 4, in which the second sheet drive roller 49 is located in the sheet feed path.

A solenoid, or a rotary actuator 67 acting through a central shaft 68, sequentially actuates the yoke 56 to the first or rest position shown in FIGS. 2 and 3 for driving any sheet in the first direction 59 past the stacking location 61, and then to the second position shown in FIG. 4 for driving the particular sheet 45 in the second direction 63 into the stacking location 13 or 61.

In the illustrated preferred embodiment of the subject invention, the yoke mounting bracket 53 pivots the yoke 56 about an axis of rotation of the first sheet drive roller 48 for movement between the above mentioned first and second positions of the yoke. In other words, the yoke 56 preferably is mounted for angular movement about the axis of rotation of the first sheet drive roller 48. This not only provides for a convenient and efficient jam-free arrangement, but also enables a particularly economical and effective drive for the second drive roller 49. Thus, in the illustrated preferred embodiment of the invention, the second sheet drive roller 49 peripherally engages the first sheet drive roller 48 for rotation thereby in the second direction 62.

In this respect, a single motor or other drive 71 may be employed for rotating the first sheet drive roller 48 via a hollow shaft 72 indicated in FIG. 1, and the second sheet drive roller 49 via the first sheet drive roller 48. The yoke actuating shaft 68 may extend through the hollow roller drive shaft 72, or another arrangement may be employed for selectively actuating the yoke 56 to and between its above mentioned positions and for driving the rollers 48 and 49.

Considering the illustrated preferred embodiment further, it is seen from FIG. 4 that it maintains with the second sheet drive roller 49 each sheet 45 out of engagement with the first sheet drive roller 48 during the driving of the particular sheet in the second direction 63 and into the stacking location 61. In this manner, the illustrated preferred embodiment of the invention advantageously avoids simultaneous subjection of any sheet to the counteracting forces and effects of rollers rotating in opposite directions. The illustrated preferred embodiment thus avoids a situation of the type occurring in the above mentioned document stacking apparatus of U.S. Pat. No. 4,241,909, in which a power drive roller arrangement is compelled to exert sufficient drive power on each sheet to move not only a baffle similar to the illustrated backup plate 21, but also to push the advancing sheet initially against the above mentioned counter-rotating sheet retarding mechanism.

Reverting now to the backup plate 21, it is seen that the arm 22 and spring 29 bias such backup plate toward the sheet drive rollers 48 and 49. The arm 22, bracket 27 and pivot pin 28 further position the backup plate 21 into a trajectory of the second sheet drive roller 49 for actuation thereby during movement of the yoke 56 from the first position shown in FIGS. 2 and 3 to its second position shown in FIG. 4. In this manner, the backup plate 21 is pushed into the stacking arrangement by laterally or radially moving second sheet drive roller 49, for a guidance of the reversely advancing sheet to the stacking position 61.

The illustrated preferred embodiment further provides at the sheet feed path 51 a sheet stack retaining wall 74 being shorter in the mentioned first direction 59 than the shortest of the anticipated lengths of the sheets to be stacked. The sheet stack retaining wall 74 is preferably located at the stacking location 61.

Figure 5:
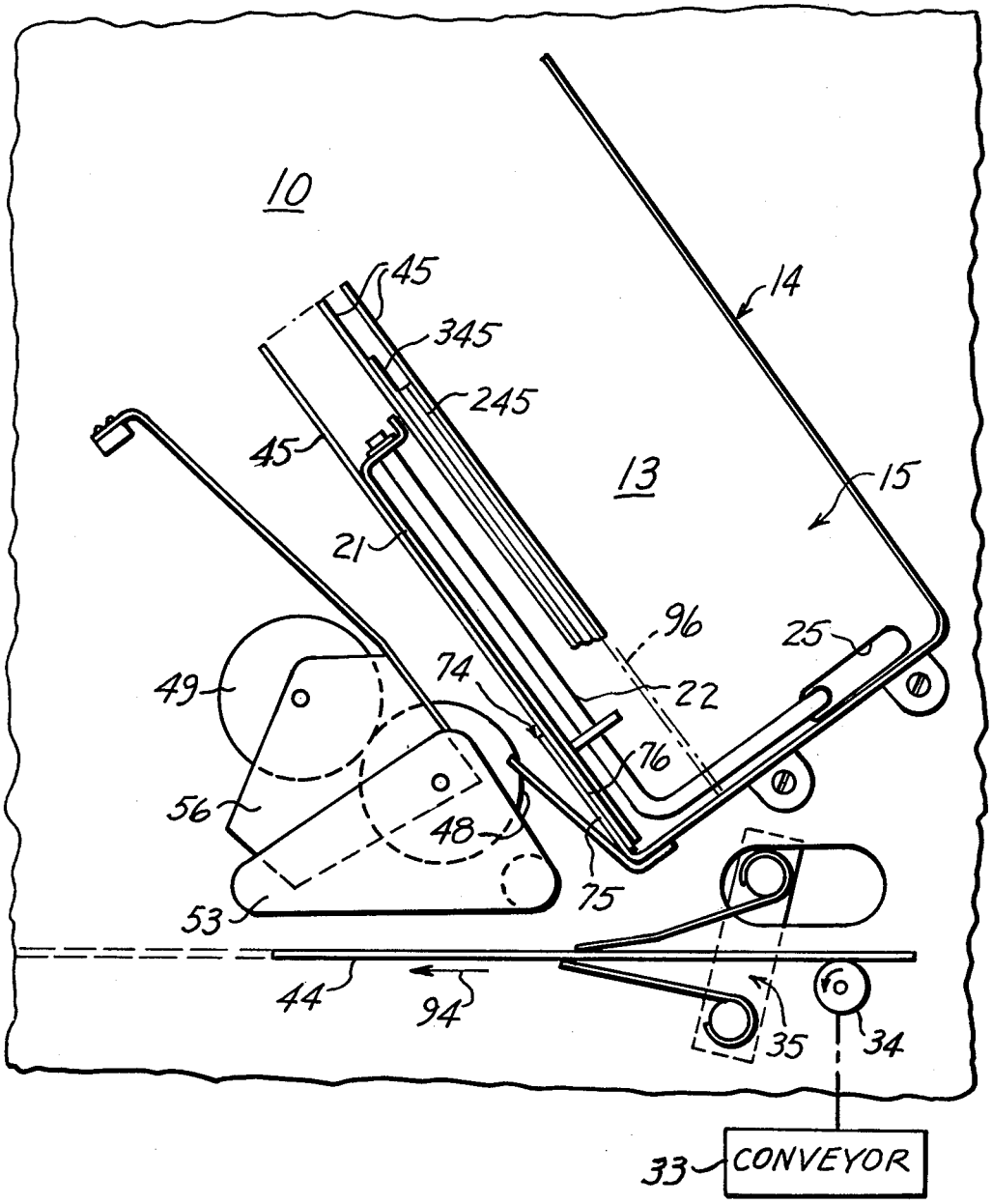

The feed stack retaining wall 74 has an outside 75 and an inside 76 designated, for instance, in FIGS. 3 to 5. As seen in FIG. 3, incoming sheets 45 are driven in the mentioned first direction 59 past the outside 75 of the retaining wall 74. Conversely, as seen in FIG. 4, the latter sheets are thereafter driven in the mentioned second direction 63 into their stacking location at the inside 76 of the retaining wall 74, opposite its outside 75.

Again, components 53, 56 and 67 maintain, for each of the sheets 45, the second sheet drive roller 49 out of the sheet feed path 51 while driving the particular sheet 45 with the first sheet drive roller 48 in the first direction 59 past the outside 75 of the sheet stack retaining wall 74. Thereafter, for each of the sheets 45 driven past the retaining wall 74, the second sheet drive roller 49 is introduced into the sheet feed path 51 for driving the particular sheet in the second direction 63 into the stacking location at the inside 76 of the retaining wall 74 opposite the outside 75.

In terms of the sheet stack retaining wall 74, the illustrated preferred embodiment thus provides means 53, 56 and 67 coupled to the first and second drive rollers for first maintaining, for each of the sheets 45, the second sheet drive roller 49 out of the sheet feed path 51, while applying to the particular sheet 45 first the first sheet drive roller 48 and for then introducing the second sheet drive roller 49 into the sheet feed path 51 for driving the particular sheet in the second direction 63 into the stacking location at the inside 76 of the retaining wall 74 opposite its outside 75.

In this respect, the actuator 67 shown in FIGS. 1, or equivalents thereof, sequentially actuates the yoke 56 to its first position illustrated in FIGS. 2 and 3 for driving any sheet 45 in the first direction 59 past the outside 75 of the retaining wall 74, and to the second position illustrated in FIG. 4, for driving the particular sheet in the second direction 63 into the stacking location at the inside 76 of the retaining wall opposite its outside 75.

Again, the actuated second sheet drive roller 49, as seen in FIG. 4, maintains each sheet 45 out of engagement with the first sheet drive roller 48 during the driving of the particular sheet in the second direction 63 into the stacking location at the inside 76 of the retaining wall 74. An important distinction from the type of design disclosed in the above mentioned U.S. Pat. No. 4,241,909 may be noted in this respect.

In particular, the illustrated preferred embodiment of the subject invention provides the first sheet drive roller 48 with an outermost periphery 77 located at the outside 75 of the retaining wall and spaced from such retaining wall 74 by a distance corresponding to a predetermined width of the sheet feed path 51, with said outermost periphery 77 and said retaining wall 74 laterally delimiting said sheet feed path 51 extending therebetween, as apparent from FIGS. 2 and 3. Each of the sheets 45 is then driven with the outermost periphery 77 of the first sheet drive roller 48 in the first direction 59 through said sheet feed path past the outside 75 of the retaining wall 74 while maintaining such outermost periphery 77 of the first sheet drive roller 48 at the mentioned distance from the retaining wall 74.

Similarly, the outermost periphery 77 of the first sheet drive roller 48 is maintained outside of the retaining wall 74 and spaced by the mentioned distance from such retaining wall, while each sheet is driven in the second direction 63 into the stacking location at the inside 76 of the retaining wall.

In practice, this assures a positive drive for each sheet within a wide range of stacking speeds, combined with low wear and high reliability of operation of the rollers 48 and 49 and prevention of simultaneous application of counteracting forces to any sheet. In this respect, it is apparent from FIGS. 3, 4 and 5 that the sheet drive roller means 48 is maintained radially stationary at the sheet feed path 51 before, during and after each introduction of the second sheet drive roller means 49 into the sheet feed path. As further apparent from FIG. 3, each of the sheets 45 conveyed to the first sheet drive roller means 48 is applied from the sheet feed path 51 to the radially stationary first sheet drive roller means 48.

FIG. 1 diagrammatically illustrates controls which may be employed according to a preferred embodiment of the subject invention. While FIG. 1 symbolically shows an electromechanical relay and switches in its disclosure, it is, of course, understood that electronic components and circuitry typically will be employed to effect the illustrated or disclosed functions.

In the control 81 shown in FIG. 1, a switch 82 may be closed to an energization of the motor 71 and rotation of the sheet drive rollers 48 and 49 via hollow shaft 72.

A switch 83 is closed for operation of the sheet conveyor 33. A switch 84 is closed when it is desired to feed a particular conveyed sheet 45 into the particular stacker 10. In this manner, the actuator 46 is energized for an actuation of the gate 35 from its rest position illustrated in FIGS. 2 and 5 to its active position shown in FIGS. 3 and 4. The control 81 may serve other stackers in this respect, and several further switches 85 are shown in FIG. 1 to indicate an arrangement in which conveyed sheets are selectively applied to different stackers. Also, unlike the showing of FIG. 4, the sheet gate 35 may immediately be returned to its rest position as soon as the sheet has reached its position 145 shown in FIG. 3.

Reverting to the illustrated stacker 10, it is seen from FIG. 3 that a conveyed sheet 45 is applied to the first sheet drive roller 48 rotating in the first sense of rotation 58 for driving the particular sheet along the sheet feed path 51 in the first direction 59 past the stacking position 61 or outside 75 of the retaining wall 74, as indicated by dotted lines 145 in FIG. 3. A sheet sensor 87 diagrammatically shown in FIG. 1 senses when the advancing sheet has reached its overshot position 145 shown in FIG. 3. Sheet sensing switches of the type disclosed in the above mentioned U.S. Pat. No. 3,148,879 may be employed for this purpose, but it is generally more advantageous to employ state of the art electro-optical sensors instead, such as at a location in the region of the first sheet drive roller 48 and end of the retaining wall 74.

At any rate, the sheet sensor 87 energizes a relay 88 or electronic switching equivalent upon detection of a sheet in its deliberately overshot position 145, where its trailing edge has surpassed the length of the retaining wall 74 in the first sheet advance direction 59. In consequence, a switch 89 is closed for energization of the yoke actuator 67.

The yoke 56 is thus actuated from its first position shown in FIGS. 2 and 3 to its second position shown in FIG. 4. The second sheet drive roller 49 thereby moves into the sheet feed path 51 along a trajectory in which the sheet stack backup plate 21 is located. In practice, the sensor 87 may be located near the gate 35 in order to cause a return of the gate to its rest position after the sheet 45 has passed through the gate, and in order to cause actuation of the yoke 56 to its advanced position shown in FIG. 4 after the sheet has overshot the wall 74.

The laterally or radially moving second sheet drive roller 49 thus actuates the backup plate 21 into the stacking location 13 against its spring bias at 29 (see FIG. 1). In particular, the backup plate 21 is initially biased by the spring 29 against or toward the inside 76 of the retaining wall 74. Each time the yoke 56 is actuated to its second position shown in FIG. 4, the thereby laterally swinging second sheet drive roller 49 impacts on the backup plate 21 via an intervening sheet 45, thereby pushing the backup plate into the stacking bin 15 and providing a stacking location sheet feed path 91, as shown in FIG. 4.

The actuated second sheet feed roller 49, rotating in the second sense of rotation 62, drives the particular deliberately overshot sheet 45 through the opened second sheet feed path 91 into the stacking location at the inside 76 of the retaining wall 74. As seen in FIGS. 2 to 5, the stacker may be provided with a leaf spring 92 for guiding the sheet into the second sheet feed path. In particular, the spring 92 helps the second roller 49 to maintain the sheet 45 away from the first roller 48 during the travel of the sheet in the second direction 63 and into the second sheet feed path 91. In similarity to the cutout 65 shown in FIG. 1, the leaf spring 92 may have a cutout so as to avoid direct contact by the second roller 49.

The yoke actuator 67 is deenergized, such as by opening of the switch 89, upon the reversely driven sheet 45 reaching its stacking position partially behind the retaininw wall 74. A sheet sensor (not shown) similar to the sensor 87, may be employed for this purpose, or the signal from the sensor 87 may be appropriately timed.

As shown in FIG. 5, the yoke 56 thereby returns to its first position, whereby the stacker 10 is ready to receive the next sheet intended for it. The yoke actuator 67 may be equipped with a yoke return spring for this purpose.

Pending arrival of the next sheet to be fed to the particular stacker, the switch 84 may be opened, whereby the gate 35 will return to its rest position, so that sheets 44 not intended for the particular stacker bypass that stacker in the direction 94 shown in FIGS. 2 and 5.

As diagrammatically indicated at 96 in FIG. 5, sheets 45, 245, 345, etc. of various intermixed lengths, thicknesses and other characteristics may be reliably received in the stacker 10, to be stacked therein upon selective actuation of the gate 53 and sequential actuation of the yoke 56, in the manner described above.

For reliable operation, the friction of the sheet drive roller 49 should exceed the friction between sheets 45, 245, 345, etc. This is easily accomplished in practice without any need to resort to the soft and rapidly wearing elastomeric materials of certain previously known document stacking apparatus.

The subject invention and its preferred embodiments thus meet their initially stated objectives and provide, for instance, sheet stackers which can within the same stacking operation accommodate all kinds of differently sized and constituted sheets without reliance on a position-dependent gravity bias. Stackers according to the subject invention and its preferred embodiments distinguish themselves in terms of positive operation, high reliability and minimum of wear and tear, not only on the stacker components, but also on the stacked materials.

The subject extensive disclosure will render apparent or suggest to those skilled in the art various modifications and variations within the spirit and scope of the subject invention and equivalents thereof.

We claim:

1. In a method of stacking sheets of various intermixed lengths in a stacking location with the aid of distinct first and second sheet drive roller means at a sheet feed path adjacent said stacking location, the improvement comprising in combination:

rotating said first sheet drive roller means in a first sense of rotation for driving each of said sheets along said sheet feed path in a first direction;

maintaining for each of said sheets said second sheet drive roller means out of said sheet feed path while driving the particular sheet with said first sheet drive roller means in said first direction past a stacking position at the stacking location;

rotating said second sheet drive roller means in a second sense of rotation for driving each of said sheets in a second direction opposed to said first direction; and introducing for each of said sheets driven past said stacking position said second sheet drive roller means into said sheet feed path for driving the particular sheet in said second direction into said stacking location;

said first sheet drive roller means being maintained radially stationary at said sheet feed path before, during and after each introduction of said second sheet drive roller means into said sheet feed path; and each of said sheets being applied to said radially stationary first sheet drive roller means for driving along said sheet feed path in said first direction.

2. A method as claimed in claim 1, including the steps of:

conveying each of said sheets to said first sheet drive roller means; and maintaining said first sheet drive roller means radially stationary at said sheet feed path during said conveying and during said driving in at least said first direction.

3. A method as claimed in claim 1 or 2, including the step of:

resiliently biasing each of said sheets, one at a time, into driving engagement with said first sheet drive roller means.

4. A method as claimed in claim 1, including the steps of:

maintaining with said second sheet drive roller means each sheet out of engagement with said first sheet drive roller means during said driving of the particular sheet in said second direction and into said stacking location.

5. In a method of stacking sheets of various intermixed lengths in a stacking location with the aid of distinct first and second sheet drive roller means at a sheet feed path adjacent said stacking location, the improvement comprising in combination:

providing at said sheet feed path a sheet stack retaining wall being shorter in a first direction than the shortest of said lengths;

rotating said first sheet drive roller means in a first sense of rotation for driving each of said sheets along said sheet feed path in said first direction:

maintaining for each of said sheets said second sheet drive roller means out of said sheet feed path while driving the particular sheet with said first sheet drive roller means in said first direction past an outside of said sheet stack retaining wall;

rotating said second sheet drive roller means in a second sense of rotation for driving each of said sheets in a second direction opposed to said first direction;

introducing for each of said sheets driven past said retaining wall said second sheet drive roller means into said sheet feed path for driving the particular sheet in said second direction into said stacking location at an inside of said retaining wall opposite said outside; and pressing said sheet in said stacking location against said inside of the retaining wall.

6. A method as claimed in claim 5, including the steps of:

maintaining with said second sheet drive roller means each sheet out of engagement with said first sheet drive roller means during said driving of the particular sheet in said second direction into said stacking location at said inside of the retaining wall.

7. A method as claimed in claim 5, including the steps of:

providing said first sheet drive roller means with an outermost periphery located at the outside of said retaining wall and spaced from said retaining wall by a distance corresponding to a predetermined width of said sheet feed path with said outermost periphery and said retaining wall laterally delimiting said sheet feed path extending therebetween; and driving each of said sheets with said outermost periphery of said first sheet drive roller means in said first direction through said sheet feed path past said outside of the retaining wall while maintaining said outermost periphery of the first sheet drive roller means at said distance from the retaining wall.

8. A method as claimed in claim 5, including the steps of:

providing said first sheet drive roller means with an outermost periphery located at the outside of said retaining wall and spaced from said retaining wall by a distance corresponding to a predetermined width of said sheet feed path; and maintaining said outermost periphery of the first sheet drive roller means outside of said retaining wall and spaced by said distance from the retaining wall while each sheet is driven in said second direction into the stacking location at said inside of the retaining wall.

9. A method as claimed in claim 5, including the steps of:

providing said first sheet drive roller means with an outermost periphery located at the outside of said retaining wall and spaced from said retaining wall by a distance corresponding to a predetermined width of said sheet feed path with said outermost periphery and said retaining wall laterally delimiting said sheet feed path extending therebetween;

driving each of said sheets with said first sheet drive roller means in said first direction through said sheet feed path past said outside of the retaining wall while maintaining said outermost periphery of the first sheet drive roller means at said distance from the retaining wall; and maintaining said outermost periphery of the first sheet drive roller means outside of said retaining wall and spaced by said distance from the retaining wall while each sheet is driven in said second direction into the stacking location at said inside of the retaining wall.

10. A method as claimed in claim 5, 6, 7, 8 or 9, including the step of:

resiliently biasing each of said sheets, one at a time, into driving engagement with said first sheet drive roller means.

11. In apparatus for stacking sheets of various intermixed lengths in a stacking location, the improvement comprising in combination:

means for driving said sheets to said stacking location, including first sheet drive roller means rotating in a first sense of rotation for driving each of said sheets along a sheet feed path in a first direction past a stacking position at the stacking location;

second sheet drive roller means rotating in a second sense of rotation for driving each of said sheets in a second direction opposed to said first direction;

means coupled to said first and second drive rollers for first maintaining for each of said sheets said second sheet drive roller means out of said sheet feed path while applying to the particular sheet first said first sheet drive roller means and for then introducing said second sheet drive roller means into said sheet feed path for driving the particular sheet in said second direction into said stacking location; and means for maintaining said first sheet drive roller means radially stationary at said sheet feed path before, during and after each introduction of said second sheet drive roller means into said sheet feed path;

said driving means including means for applying each of said sheets to said radially stationary first sheet drive roller means for said driving of each of said sheets along said sheet feed path in said first direction.

12. Apparatus as claimed in claim 11, including:

means for conveying each of said sheets to said first sheet drive roller means; and means connected to said first sheet drive roller means for maintaining said first sheet drive roller means radially stationary at said sheet feed path during said conveying and during said driving in at least said first direction.

13. Apparatus as claimed in claim 11 or 12, including:

means at said first sheet drive roller means for resiliently biasing each of said sheets, one at a time, into driving engagement with said first sheet drive roller means.

14. Apparatus as claimed in claim 11, including:

means for maintaining with said second sheet drive roller means each sheet out of engagement with said first sheet drive roller means during said driving of the particular sheet in said second direction and into said stacking location.

15. In apparatus for stacking sheets of various intermixed lengths in a stacking location, the improvement comprising in combination:

a sheet stack retaining wall at said stacking location, being shorter in a first direction than the shortest of said lengths;

means for driving said sheets to said stacking location, including first sheet drive roller means rotating in a first sense of rotation for driving each of said sheets along a sheet feed path in said first direction past an outside of said sheet stack retaining wall;

second sheet drive roller means rotating in a second sense of rotation for driving each of said sheets in a second direction opposed to said first direction;

means coupled to said first and second drive roller means for first maintaining for each of said sheets said second sheet drive roller means out of said sheet feed path while applying to the particular sheet first said first sheet drive roller means and for then introducing said second sheet drive roller means into said sheet feed path for driving the particular sheet in said second direction into said stacking location at an inside of said retaining wall opposite said outside; and means for pressing the latter sheet in said stacking location against said inside of the retaining wall.

16. Apparatus as claimed in claim 15, including:

means for maintaining with said second sheet drive roller means each sheet out of engagement with said first sheet drive roller means during said driving of the particular sheet in said second direction into said stacking location at said inside of the retaining wall.

17. Apparatus as claimed in claim 15, wherein:

said first sheet drive roller means have an outermost periphery located at the outside of said retaining wall and spaced from said retaining wall by a distance corresponding to a predetermined width of said sheet feed path with said outermost periphery and said retaining wall laterally delimiting said sheet feed path extending therebetween; and said first sheet drive roller means include means for driving each of said sheets with said outermost periphery of said first sheet drive roller means in said first direction through said sheet feed path past said outside of the retaining wall while maintaining said outermost periphery of the first sheet drive roller means at said distance from the retaining wall.

18. Apparatus as claimed in claim 15, wherein:

said first sheet drive roller means have an outermost periphery located at the outside of said retaining wall and spaced from said retaining wall by a distance corresponding to a predetermined width of said sheet feed path; and said first sheet drive roller means include means for maintaining said outermost periphery of the first sheet drive roller means outside of said retaining wall and spaced by said distance from the retaining wall while each sheet is driven in said second direction into the stacking location at said inside of the retaining wall.

19. Apparatus as claimed in claim 15, wherein:

said first sheet drive roller means have an outermost periphery located at the outside of said retaining wall and spaced from said retaining wall by a distance corresponding to a predetermined width of said sheet feed path with said outermost periphery and said retaining said laterally delimiting said sheet feed path extending therebetween; and said first sheet drive roller means include means for driving each of said sheets with said first sheet drive roller means in said first direction through said sheet feed path past said outside of the retaining wall while maintaining said outermost periphery of the first sheet drive roller means at said distance from the retaining wall, and for maintaining said outermost periphery of the first sheet drive roller means outside of said retaining wall and spaced by said distance from the retaining wall while each sheet is driven in said second direction into the stacking location at said inside of the retaining wall.

20. Apparatus as claimed in claim 15, 16, 17, 18 or 19, including:

means for resiliently biasing each of said sheets, one at a time, into driving engagement with said first sheet drive roller means.

21. In apparatus for stacking sheets of various intermixed lengths in a stacking location, the improvement comprising in combination:

means for driving said sheets to said stacking location, including first sheet drive roller means rotating in a first sense of rotation for driving each of said sheets along a sheet feed path in a first direction past a stacking position at the stacking location;

second sheet drive roller means rotating in a second means of rotation for driving each of said sheets in a second direction opposed to said first direction;

a yoke for mounting said first and second drive rollers;

means for mounting said yoke for movement from a first position in which said second sheet drive roller means are maintained out of said sheet feed path while a sheet is applied to said first sheet drive roller means, to a second position in which said second sheet drive roller means are located in said sheet feed path;

means for sequentially actuating said yoke to said first position for driving any sheet in said first direction past said stacking location, and to said second position for introducing said second sheet drive roller means into said sheet feed path for driving the particular sheet in said second direction into said stacking location; and means for maintaining said first sheet drive roller means radially stationary at said sheet feed path before, during and after each introduction of said second sheet drive roller means into said sheet feed path;

said driving means including means for applying each of said sheets to said radially stationary first sheet drive roller means for said driving of each of said sheets along said sheet feed path in said first direction.

22. Apparatus as claimed in claim 21, wherein:

said means for mounting said yoke include means for pivoting said yoke about an axis of rotation of said first sheet drive roller means for movement between said first and second positions.

23. Apparatus as claimed in claim 21, wherein:

said second sheet drive roller means peripherally engage said first sheet drive roller means for rotation thereby in said second direction.

24. Apparatus as claimed in claim 21, wherein:

said means for mounting said yoke include means for pivoting said yoke about an axis of rotation of said first sheet drive roller means for movement between said first and second positions; and said second sheet drive roller means peripherally engage said first sheet drive roller means for rotation thereby.

25. Apparatus as claimed in claim 21, 22, 23 or 24, including:

means at said first sheet drive roller means for resiliently biasing each of said sheets, one at a time, into driving engagement with said first sheet drive roller means.

26. Apparatus as claimed in claim 21, 22, 23 or 24, including:

a backup plate in said stacking location for releasably retaining stacked sheets in said stacking location;

means for biasing said backup plate toward said sheet drive roller means; and means for positioning said backup plate into a trajectory of said second sheet drive roller means for actuation thereby during movement of said yoke from said first to said second position.

27. In apparatus for stacking sheets of various intermixed lengths in a stacking location, the improvement comprising in combination:

a sheet stack retaining wall at said stacking location, being shorter in a first direction than the shortest of said lengths;

means for driving said sheets to said stacking location, including first sheet drive roller means rotating in a first sense of rotation for driving each of said sheets along a sheet feed path in said first direction past an outside of said sheet stack retaining wall;

second sheet drive roller means rotating in a second sense of rotation for driving each of said sheets in a second direction opposed to said first direction;

a yoke for mounting said first and second drive rollers;

means for mounting said yoke for movement from a first position in which said second sheet drive roller means are maintained out of said sheet feed path while a sheet is applied to said first sheet drive roller means, to a second position in which said second sheet drive roller means are located in said sheet feed path; and means for sequentially actuating said yoke to said first position for driving any sheet in said first direction past said outside of the retaining wall, and to said second position for driving the particular sheet in said second direction into said stacking location at an inside of said retaining wall opposite said outside; and means for pressing the latter sheet in said stacking location against said inside of the retaining wall.

28. Apparatus as claimed in claim 27, wherein:

said pressing means include a backup plate for releasably retaining stacked sheets in said stacking location, and means for biasing said backup plate toward said inside of the retaining wall; and means for positioning said backup plate into a trajectory of said second sheet drive roller means for actuation thereby during movement of said yoke from said first to said second position.

29. Apparatus as claimed in claim 27 or 28, wherein:

said means for mounting said yoke include means for pivoting said yoke about an axis of rotation of said first sheet drive roller means for movement between said first and second positions.

30. Apparatus as claimed in claim 29, wherein:

said second sheet drive roller means peripherally engage said first sheet drive roller means for rotation thereby in said second direction.

* * * * *